US010196781B2

(12) United States Patent
Han et al.

(10) Patent No.: US 10,196,781 B2
(45) Date of Patent: Feb. 5, 2019

(54) HYPEREUTECTOID STEEL RAIL AND PREPARATION METHOD THEREOF

(71) Applicants: PANGANG GROUP PANZHIHUA IRON & STEEL RESEARCH INSTITUTE CO., LTD., Panzhihua (CN); PANGANG GROUP PANZHIHUA STEEL & VANADIUM CO., LTD., Panzhihua (CN)

(72) Inventors: Zhenyu Han, Panzhihua (CN); Ming Zou, Panzhihua (CN); Hua Guo, Panzhihua (CN); Yuan Wang, Panzhihua (CN); Dadong Li, Panzhihua (CN); Yong Deng, Panzhihua (CN); Jun Yuan, Panzhihua (CN)

(73) Assignees: PANGANG GROUP PANZHIHUA IRON & STEEL RESEARCH INSTITUTE CO., LTD., Panzhihua (CN); PANGANG GROUP PANZHIHUA STEEL & VANADIUM CO., LTD., Panzhihua (CN)

( * ) Notice: Subject to any disclaimer, the term of this patent is extended or adjusted under 35 U.S.C. 154(b) by 228 days.

(21) Appl. No.: 15/231,843

(22) Filed: Aug. 9, 2016

(65) Prior Publication Data

US 2017/0044721 A1 Feb. 16, 2017

(30) Foreign Application Priority Data

Aug. 11, 2015 (CN) ..... 2015 1 0487942

(51) Int. Cl.

| | |
|---|---|
| ***C21D 1/60*** | (2006.01) |
| ***C21D 8/00*** | (2006.01) |
| ***C21D 9/04*** | (2006.01) |
| ***E01B 5/02*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/46*** | (2006.01) |
| ***C22C 38/48*** | (2006.01) |
| ***C21D 1/613*** | (2006.01) |

(52) U.S. Cl.

CPC ..... *E01B 5/02* (2013.01); *C21D 1/60* (2013.01); *C21D 1/613* (2013.01); *C21D 8/005* (2013.01); *C21D 9/04* (2013.01); *C22C 38/002* (2013.01); *C22C 38/02* (2013.01); *C22C 38/04* (2013.01); *C22C 38/42* (2013.01); *C22C 38/46* (2013.01); *C22C 38/48* (2013.01)

(58) Field of Classification Search

CPC .. E01B 5/02; C21D 1/60; C21D 1/613; C21D 8/005; C21D 9/04; C22C 38/002; C22C 38/02; C22C 38/04; C22C 38/08; C22C 38/12; C22C 38/16; C22C 38/20; C22C 38/24; C22C 38/26; C22C 38/42; C22C 38/46; C22C 38/48

See application file for complete search history.

(56) References Cited

U.S. PATENT DOCUMENTS

| | | | | |
|---|---|---|---|---|
| 5,658,400 | A | 8/1997 | Uchino et al. | |
| RE42,668 | E | 9/2011 | Ueda et al. | |
| 8,404,178 | B2 * | 3/2013 | Honjo | C21D 8/00 420/104 |
| 2011/0253268 | A1 * | 10/2011 | Zou | C21D 1/667 148/584 |
| 2013/0193223 | A1 | 8/2013 | Mei et al. | |
| 2015/0232968 | A1 | 8/2015 | Zou et al. | |
| 2016/0083820 | A1 * | 3/2016 | Kimura | C21D 8/00 148/584 |
| 2017/0044634 | A1 * | 2/2017 | Ueda | C21D 9/04 |

FOREIGN PATENT DOCUMENTS

| | | | |
|---|---|---|---|
| CN | 1140473 | A | 1/1997 |
| CN | 1041443 | C | 12/1998 |
| CN | 101818312 | A | 9/2010 |
| CN | 101921950 | A | 12/2010 |
| CN | 104046765 | A | 9/2014 |
| CN | 104060065 | A | 9/2014 |
| CN | 104060187 | A | 9/2014 |
| CN | 104087836 | A | 10/2014 |
| CN | 104120354 | A | 10/2014 |
| CN | 105018705 | * | 11/2015 |
| JP | 2006-045622 | A | 2/2006 |
| WO | WO 2014/157252 | * | 10/2014 |
| WO | WO 2015/182743 | * | 12/2015 |

OTHER PUBLICATIONS translation for CN 105018705, Nov. 4, 2015.*

* cited by examiner

*Primary Examiner* — C Melissa Koslow

(74) *Attorney, Agent, or Firm* — Volpe and Koenig, P.C.

(57) ABSTRACT

The present invention discloses a method for preparing hypereutectoid steel rail in which the composition of the billets adopted is: C: 0.86-1.05 wt. %; Si: 0.3-1 wt. %; Mn: 0.5-1.3 wt. %; Cr: 0.15-0.35 wt. %; Cu: 0.3-0.5 wt. %; P: 0.02-0.04 wt. %; S: ≤0.02 wt. %; Ni: ½-⅔ of the content of Cu; at least one of V, Nb and Re; Fe and unavoidable impurities of the rest. The present invention further provides a hypereutectoid steel rail prepared by the foregoing method. By the hypereutectoid steel rail preparation method provided by the present invention, the high-carbon billets with a specific composition provided by the present invention can be made into hypereutectoid steel rails with good corrosion resistance and tensile properties.

17 Claims, No Drawings

HYPEREUTECTOID STEEL RAIL AND PREPARATION METHOD THEREOF

CROSS REFERENCE TO RELATED APPLICATION

This application claims priority to Chinese Patent Application No. 201510487942.1, filed Aug. 11, 2015, the entire contents of which is incorporated herein by reference as if fully set forth.

FIELD OF THE INVENTION

The present invention relates to a hypereutectoid steel rail and its preparation method.

BACKGROUND

The fast development of railway transport sets higher requirements for service performance of steel rails, of freight railway and heavy-load special railway in particular. Following the continuous increase of axle weight, traffic density and carrying gross weight, the service environment of steel rails tends to be rigorous. Particularly, the curve sections with a small radius are hardest hit, the wear of steel rails is serious, and some steel rails have to be replaced in less than one year after service, seriously restricting railway transport efficiency. Railway sector is in urgent need for steel rail products with better performance. Meanwhile, in coastal areas and humid tunnels, steel rails also face the problem of fast corrosion. The interaction between rail flange and gasket as well as ballast bed results in formation of dotted or blocky corrosion pits at rail flange. Under the action of repeated stress of wheels, the corrosion pits are extended quickly towards rail web and railhead, thus resulting in rail fracture failure, endangering traffic safety. Therefore, the development trend of long life and low maintenance of railway requires steel rails to possess multiple properties such as resistance to wear, contact fatigue, corrosion and brittle failure. It indicates by research that the corrosion resistance of steel rails may be improved normally by the following three methods: firstly, by applying a corrosion-resistant material on the surface layer, a substrate-isolating layer was artificially covered on the surface layer of steel rail to avoid contact of rail substrate with air or other media and improve corrosion resistance of the rail; secondly, improving corrosion resistance of rail through sacrificial anode; thirdly, adding Cu, Cr, Ni and other corrosion-resistant elements to general carbon steel rail to raise the corrosion resistance of rail substrate. At present, the research of the third method is more urgent. Chinese Patent Application No. 101818312A discloses steel of corrosion-resistant heavy rail with good toughness, fatigue resistance and corrosion resistance. Weight percentage composition of alloy elements in the basic alloy system: C: 0.55%~0.72%, Si: 0.35%~1.1%, Mn: 0.7~1.40%, Cr: 0.2%~0.65%, Cu: 0.2%~0.65%, rest: Fe. On the basis of the above basic composition, one or a plurality of microalloy elements Nb, V, Ti, Ni and Mo are added, wherein Nb: 0.01%~0.055%, V: 0.05%~0.10%, Ti: 0.001%~0.05%; Ni: 0.1%~0.3%, Mo: 0.15%~0.3%. This patent application addresses the problem of toughness, fatigue resistance, wear resistance and corrosion resistance of low carbon or ultra-low carbon steel. For example, tensile strength is about 1100 MPa, and corrosion rate is about 2 $g/m^2 \cdot h$. However, the rail disclosed in the above patent application can hardly meet the transport requirements of heavy haul railway of large axle weight and large traffic volume and is not applicable to performance enhancement of steel rails and other high-carbon steel.

SUMMARY

The object of the present invention is to provide a hypereutectoid steel rail that has an element composition applicable to high-carbon steel rail and can acquire good corrosion resistance, as well as a preparation method thereof.

In order to realize the above object, the present invention provides a method for preparing a hypereutectoid steel rail comprising:

rolling a billet after temperature holding treatment to obtain a steel rail, implementing natural cooling till railhead surface temperature is reduced to 750-850° C., carrying out the first cooling stage by adopting a cooling medium to reduce railhead surface temperature to 350-550° C., and then carrying out the second cooling stage by air cooling to reduce railhead surface temperature to 15-40° C., wherein, composition of the billet is: C: 0.86-1.05 wt. %; Si: 0.3-1 wt. %; Mn: 0.5-1.3 wt. %; Cr: 0.15-0.35 wt. %; Cu: 0.3-0.5 wt. %; P: 0.02-0.04 wt. %; S: ≤0.02 wt. %; Ni: ½-⅔ of the content of Cu; at least one of V, Nb and Re; Fe and unavoidable impurities of the rest; under the condition that there is at least one of V, Nb and Re, the content of V is 0% or 0.04-0.12 wt. %, the content of Nb is 0% or 0.02-0.06 wt. %, and the content of Re is 0-0.05 wt. %.

The present invention further provides a hypereutectoid steel rail prepared by the foregoing method.

By the hypereutectoid steel rail preparation method provided by the present invention, the high-carbon billet with a specific composition can be made into a hypereutectoid steel rail with good corrosion resistance and tensile properties. For example, the corrosion rate in a 0.05 mol/L $NaHSO_3$ solution is 1.48 $g/m^2 \cdot h$ or less, the corrosion rate in a 2 wt. % NaCl solution is 1 $g/m^2 \cdot h$ or less, tensile strength can be 1350 MPa or above and elongation can be 9% or above. Particularly, hypereutectoid steel rails with a microscopic structure of pearlite+trace-amount secondary cementite may be obtained.

Other features and advantages of the present invention will be described in details in the subsequent embodiments.

DETAILED DESCRIPTION

Hereunder the embodiments of the present invention will be specified in details. It should be appreciated that the embodiments described here are only provided to describe and explain the present invention, but shall not be deemed as constituting any limitation to the present invention.

The present invention provides a method for preparing a hypereutectoid steel rai comprising:

rolling a billet after temperature holding treatment to obtain a steel rail, implementing natural cooling till railhead surface temperature is reduced to 750-850° C., carrying out the first cooling stage by adopting a cooling medium to reduce railhead surface temperature to 350-550° C., and then carrying out the second cooling stage by air cooling to reduce railhead surface temperature to 15-40° C., wherein, composition of the billet: C: 0.86-1.05 wt. %; Si: 0.3-1 wt. %; Mn: 0.5-1.3 wt. %; Cr: 0.15-0.35 wt. %; Cu: 0.3-0.5 wt. %; P: 0.02-0.04 wt. %; S: ≤0.02 wt. %; Ni: ½-⅔ of the content of Cu; at least one of V, Nb and Re; Fe and unavoidable impurities of the rest; under the condition that there is at least one of V, Nb and Re, the content of V is 0% or 0.04-0.12 wt. %, the content of Nb is 0% or 0.02-0.06 wt. %, and the content of Re is 0-0.05 wt. %.

According to the present invention, the inventor of the present invention discovered that when the component content of the billet is controlled in the above composition range, a hypereutectoid steel rail with good corrosion resistance and tensile property may be obtained by the cooling method given in the method of the present invention. Preferably, in the billet, the content of C is 0.9-1.05 wt. %, the content of Si is 0.4-1 wt. %, the content of Mn is 0.8-1.3 wt. % and the content of P is 0.025-0.04 wt. %.

According to the present invention, the billet contains at least one of V, Nb and Re, preferably one of V, Nb and Re. When the billet contains one of V, Nb and Re, the billet contains 0.04-0.12 wt. % of V, or 0.02-0.06 wt. % of Nb, or 0.01-0.05 wt. % of Re.

According to the present invention, the billet containing the foregoing composition may be obtained by a conventional method in the field. For example, molten steel containing the foregoing composition is smelted in a converter or an electric furnace, it is continuously cast into blooms through external refining and vacuum degassing treatment, and the blooms are sent into a heating furnace for heating and temperature holding to obtain billet of the present invention after temperature holding treatment. The specific process is not described in details here.

According to the present invention, through temperature holding treatment, the billet may be heated to temperature suitable for rolling. For example, through temperature holding treatment, the billet may be heated to 1200-1300° C. There is not any particular limitation to the temperature holding treatment as long as such temperature can be reached. Preferably, the conditions of temperature holding treatment include: a temperature of 1200-1300° C., a time of 2-4 hours.

According to the present invention, groove rolling method or universal rolling method may be adopted to roll a billet after the temperature holding treatment to obtain a steel rail, thus a subsequent cooling may be conducted. There is no special limitation to the rolling conditions as long as the needed steel rail can be obtained. For example, the billet is rolled into a steel rail with a unit weight of 60-75 kg/m.

According to the present invention, after the foregoing rolling, rail temperature is lowered to some extent. For example, after the billet after temperature holding treatment at a temperature of 1200-1300° C. is rolled, a steel rail with railhead surface temperature of 900-1000° C. may be obtained. The railhead surface temperature of such steel rail is reduced to 750-850° C. by natural cooling and then the subsequent first cooling stage is conducted. If the temperature is reduced to above 850° C. by natural cooling, then in the subsequent first cooling stage, the railhead surface temperature is reduced quickly due to direct contact of cooling medium; in comparison, as the core of the railhead is subjected to heat transfer of the surface layer and certain depth of the railhead only, its temperature will be reduced, too, but slower than surface. Particularly, in the process of phase change, the surface of railhead releases latent heat of phase change, resulting in a small phase change super-cooling degree of the core of the railhead, and failure to realize uniformity and unity of cross-section performance of railhead; when temperature is reduced to below 750° C. through natural cooling, then in the subsequent first cooling stage, the surface of railhead is quickly cooled to phase change temperature in the initial period of accelerated cooling. As the super-cooling degree is large, bainite, martensite and other abnormal tissues might be generated, leading to scrapping of the rail. Therefore, in the present invention, rail is naturally cooled till railhead surface temperature is reduced to 750° C.-850° C. at first, preferably to 780-850° C., more preferably to 800-840° C.

According to the present invention, the first cooling stage is a process of using a cooling medium to reduce railhead surface temperature to 350-550° C. at a preferred speed of 1-5° C./s, wherein when the cooling speed is higher than 5° C./s, as the super-cooling degree is large, bainite, martensite and other abnormal tissues might be generated, leading to rejection of the rail; when the cooling speed is lower than 1° C./s, the rail cannot achieve a fine crystal strengthening effect through this insufficient cooing, thereby it is unable to achieve the needed higher performance.

According to the present invention, there isn't particular limitation to the way to use the cooling medium as long as the needed effect of the present invention can be obtained. For example, the first cooling stage comprises applying cooling medium to the top surface and side surfaces of the railhead. The preferred cooling medium is compressed air and/or water mist mixed gas.

According to the present invention, the first cooling stage reduces the railhead surface temperature to 350-550° C. Reason for reduction to such temperature is: when the first cooling stage reduces the railhead surface temperature to above 550° C., the phase change at the core of railhead is yet to complete. If the accelerated cooling is stopped at the moment, the core of railhead will obtain a coarse pearlite microstructure as well as a large amount of secondary cementite; when the first cooling stage reduces the railhead surface temperature to below 350° C., the phase change in full cross section of railhead is completed, and continued accelerated cooling no longer has remarkable significance. Therefore, the first cooling stage reduces railhead surface temperature to 350° C.-550° C. Preferably, the first cooling stage reduces railhead surface temperature to 350-500° C., more preferably to 400-450° C.

According to the present invention, after the first cooling stage is finished, the second cooling stage may be started by air cooling method to reduce the railhead surface temperature to 15-40° C. (room temperature). The air cooling is a cooling method adopting an air cooler and using ambient air as a cooling medium.

According to the present invention, the rail obtained by the foregoing method will become finished rail after horizontal and vertical compound straightening.

The present invention further provides a hypereutectoid steel rail prepared by the foregoing method.

It should be understood that the hypereutectoid steel rail provided by the present invention has a composition identical to that of the foregoing billet. Further, through the method provided by the present invention, a hypereutectoid steel rail with good corrosion resistance and tensile properties can be obtained. For example, the corrosion rate in a 0.05 mol/L $NaHSO_3$ solution is 1.48 $g/m^2 \cdot h$ or less, the corrosion rate in a 2 wt. % NaCl solution is 1 $g/m^2 \cdot h$ or less, tensile strength can be 1350 MPa or above and elongation can be 9% or above. Particularly, a hypereutectoid steel rail with a microscopic structure of pearlite+trace-amount secondary cementite may be obtained.

Below the present invention is described in details by referring to embodiments.

The composition of the billet adopted in the following examples is shown in Table 1. The composition of the billet adopted in comparative examples is shown in Table 2. Except the elements in Table 1 and Table 2, the rest is Fe and unavoidable impurities:

TABLE 1

| | Chemical composition/wt. % | | | | | | | | | | |
|---|---|---|---|---|---|---|---|---|---|---|---|
| No. | C | Si | Mn | P | S | Cr | Cu | Ni | V | Nb | Re |
| 1# | 0.87 | 0.58 | 1.08 | 0.028 | 0.019 | 0.27 | 0.33 | 0.20 | 0.09 | — | — |
| 2# | 0.93 | 0.46 | 1.3 | 0.039 | 0.009 | 0.35 | 0.48 | 0.26 | 0.12 | — | — |
| 3# | 0.86 | 1.00 | 0.61 | 0.040 | 0.020 | 0.22 | 0.50 | 0.33 | 0.04 | — | — |
| 4# | 0.98 | 0.67 | 0.59 | 0.030 | 0.008 | 0.31 | 0.39 | 0.24 | — | 0.06 | — |
| 5# | 0.95 | 0.3 | 0.73 | 0.022 | 0.006 | 0.19 | 0.42 | 0.29 | — | 0.04 | — |
| 6# | 0.99 | 0.79 | 0.84 | 0.025 | 0.011 | 0.15 | 0.3 | 0.18 | — | 0.02 | — |
| 7# | 1.02 | 0.93 | 0.95 | 0.037 | 0.007 | 0.30 | 0.37 | 0.22 | — | — | 0.050 |
| 8# | 1.05 | 0.81 | 1.25 | 0.038 | 0.016 | 0.26 | 0.39 | 0.26 | — | — | 0.024 |
| 9# | 1 | 0.62 | 1.17 | 0.028 | 0.018 | 0.28 | 0.44 | 0.28 | — | — | 0.038 |
| 10# | 0.91 | 0.97 | 0.5 | 0.02 | 0.013 | 0.17 | 0.41 | 0.25 | — | — | 0.005 |

TABLE 2

| | Chemical composition/wt. % | | | | | | | | | | |
|---|---|---|---|---|---|---|---|---|---|---|---|
| No. | C | Si | Mn | P | S | Cr | Cu | Ni | V | Nb | RE |
| 1# | 0.78 | 0.67 | 0.92 | 0.022 | 0.008 | 0.29 | 0.38 | 0.12 | 0.06 | | — |
| 2# | 0.79 | 0.78 | 1.31 | 0.018 | 0.006 | 0.33 | 0.49 | 0.28 | — | 0.04 | — |
| 3# | 0.86 | 0.46 | 0.88 | 0.018 | 0.010 | 0.22 | 0.33 | 0.21 | 0.08 | — | — |
| 4# | 0.89 | 0.32 | 0.94 | 0.016 | 0.008 | 0.39 | 0.49 | 0.28 | 0.12 | — | — |
| 5# | 0.88 | 0.61 | 1.14 | 0.020 | 0.011 | 0.40 | 0.48 | 0.30 | 0.04 | — | — |
| 6# | 0.90 | 0.60 | 1.24 | 0.023 | 0.006 | 0.33 | 0.40 | 0.22 | — | 0.02 | — |
| 7# | 0.86 | 0.47 | 0.81 | 0.019 | 0.007 | 0.23 | 0.41 | 0.26 | — | 0.05 | — |
| 8# | 0.87 | 0.79 | 0.81 | 0.017 | 0.010 | 0.27 | 0.29 | 0.19 | — | 0.04 | — |
| 9# | 0.75 | 0.78 | 0.90 | 0.014 | 0.010 | — | — | — | 0.06 | — | — |
| 10# | 0.71 | 0.38 | 1.05 | 0.018 | 0.006 | — | — | — | — | — | — |

Note: 9# is the composition of U75V steel rail in Chinese railway standard and 10# is the composition of U71Mn in Chinese railway standard.

EXAMPLES 1-10

The examples are intended to illustrate the hypereutectoid steel rail and its preparation method provided by the present invention.

The temperature of 1#~10# billets in Table 1 is held in a 1200° C. heating furnace for 3 h respectively to obtain billets with surface temperature of 1200° C. After temperature holding, the billets are rolled to 60 kg/m steel rails with finish rolling temperature (surface temperature after finish rolling) of 910° C. After finish rolling, the steel rails are naturally cooled till railhead surface temperature is 805° C. Cooling medium, which is water mist mixed gas, is applied on the top surface and two side surfaces of railhead so that the steel rails undergo the first stage cooling at a cooling speed of 2.5° C./s to reduce railhead surface temperature to 410° C. Then the steel rails are cooled in the air to about 20° C. After horizontal and vertical compound straightening, steel rails A1-A10 are obtained.

COMPARATIVE EXAMPLES 1-10

According to the method described in example 1, but the difference is that, 1#-10# billets shown in Table 2 are adopted to replace the 1#billet shown in Table 1 respectively to obtain steel rails D1-D10.

TEST EXAMPLE

The performance of steel rails A1-A10 and D1-D10 prepared in examples 1-10 and comparative examples 1-10 is inspected by the following method:

The tensile properties of the steel rails are determined according to China national standard GB/T228.1-2010<Metallic Material Tensile Testing at Ambient Temperature>. The determined $R_m$ (tensile strength) and A % (elongation) are shown in Table 3.

According to China national standard GB/T 13298-1991<Metal-Inspection Method of Microstructure>, MeF3 optical microscope is adopted to determine microstructure of steel rail. The result is shown in Table 3.

Cyclic immersion and accelerated corrosion test is done by simulating acidity in atmosphere and marine environment. The following parameters are set. The corrosion products on sample surface are removed according to China national standard GB/T 16545-1996. Corrosion rate is calculated with Formula $r_{corr}=m/(A\times t)$, where m is mass loss, unit is g; A is surface area of the sample, unit is $m^2$; t is corrosion time, unit is h. The result is shown in Table 3. The parameters set in the cyclic immersion and accelerated corrosion test simulating acidity in atmosphere and marine environment are as follows:

① Temperature: 45±2° C.

② Humidity: 70±5% RH

③ Time of the first cycle: 60±3 min, including 12±1.5 min of immersion time

④ Cycle period: 100 times

⑤ Maximum temperature on sample surface after baking: 70±10° C.

⑥ Solution:

Acidic environment of atmosphere: 0.05 mol/L $NaHSO_3$ water solution;

Marine environment: 2 wt. % NaCl water solution.

After the test is finished, the sample is taken out, washed with running water, dried in the air overnight and weighed.

TABLE 3

| Rail | Microstructure | Rm/MPa | A/% | Corrosion rate in $NaHSO_3$ solution g/(m$^2$ · h) | Corrosion rate in NaCl solution/ g/(m$^2$ · h) |
|---|---|---|---|---|---|
| A1 | P + $Fe_{III}C_{2(trace)}$ | 1360 | 10.5 | 1.1913 | 0.8227 |
| A2 | P + $Fe_{III}C_{2(trace)}$ | 1430 | 10 | 1.0017 | 0.864 |
| A3 | P + $Fe_{III}C_{2(trace)}$ | 1350 | 11 | 1.472 | 0.806 |
| A4 | P + $Fe_{III}C_{2(trace)}$ | 1370 | 11 | 1.0727 | 0.7137 |
| A5 | P + $Fe_{III}C_{2(trace)}$ | 1380 | 11.5 | 1.1417 | 0.7557 |
| A6 | P + $Fe_{III}C_{2(trace)}$ | 1400 | 11 | 1.1573 | 0.726 |
| A7 | P + $Fe_{III}C_{2(trace)}$ | 1430 | 10.5 | 1.1847 | 0.8043 |
| A8 | P + $Fe_{III}C_{2(trace)}$ | 1450 | 9 | 1.0553 | 0.877 |
| A9 | P + $Fe_{III}C_{2(trace)}$ | 1420 | 11 | 1.2147 | 0.7617 |
| A10 | P + $Fe_{III}C_{2(trace)}$ | 1370 | 12 | 1.2927 | 0.8057 |
| D1 | P + F(trace) | 1290 | 11.5 | 2.138 | 1.0447 |
| D2 | P + F(trace) | 1300 | 11 | 2.227 | 1.0653 |
| D3 | P + $Fe_{III}C_{2(trace)}$ | 1410 | 10.5 | 2.2427 | 1.026 |
| D4 | P + $Fe_{III}C_{2(trace)}$ | 1440 | 9 | 2.6167 | 1.0343 |
| D5 | P + $Fe_{III}C_{2(trace)}$ | 1420 | 10 | 2.6057 | 1.0857 |
| D6 | P + $Fe_{III}C_{2(trace)}$ | 1390 | 10.5 | 2.4667 | 1.0673 |
| D7 | P + $Fe_{III}C_{2(trace)}$ | 1410 | 10 | 2.3187 | 1.0133 |
| D8 | P + $Fe_{III}C_{2(trace)}$ | 1420 | 9.5 | 2.1963 | 1.0877 |
| D9 | P | 1260 | 12 | 1.9963 | 1.607 |
| D10 | P + $F_{(trace)}$ | 1110 | 12.5 | 2.1243 | 1.6867 |

Note:

P + $Fe_{III}C_{2(trace)}$ refers to pearlite + trace-amount secondary cementite, P + F(trace) refers to pearlite + trace-amount ferrite, and P refers to pearlite.

The foregoing test results indicate the hypereutectoid steel rail prepared by the method provided by the present invention has a good microstructure, good tensile strength, appropriate elongation and excellent corrosion resistance. For example, the corrosion rate in a 0.05 mol/L $NaHSO_3$ solution is 1.48 g/m$^2$·h or less (preferably 1-1.3 g/m$^2$·h), the corrosion rate in a 2 wt. % NaCl solution is 1 g/m$^2$·h or less (preferably 0.6-0.9 g/m$^2$·h), tensile strength can be 1350 MPa or above (preferably 1360-1460 MPa) and elongation can be 9% or above (preferably 10-12%). Particularly, a hypereutectoid steel rail with a microscopic structure of pearlite+trace-amount secondary cementite may be obtained. Particularly, the strength of the obtained steel rail is higher than the strength of existing U75V and U71Mn thermally treated steel rails and can meet service requirements of heavy load railway, particularly the curve sections with a small radius.

The described and illustrated embodiments are to be considered as illustrative and not restrictive in character, it being understood that only the specific embodiments according to the invention have been shown and described and that all changes and modifications that come within the scope of the invention, as set out in the accompanying claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "one" are used to preface a feature there is no intention to limit the claim to only one such feature unless specifically stated to the contrary in the claim.

Above the preferred embodiments of the present invention are described in details, but the present invention is not limited to the concrete details of the foregoing embodiments. Within the scope of the technical conception of the present invention, the technical scheme of the present invention may have various simple modifications. They all shall be within the scope of protection of the present invention.

Besides, it should be noted that the concrete technical features described in the foregoing embodiments may be combined in any appropriate way under the condition of no conflict. In order to avoid unnecessary repetition, all the possible combinations of the present invention are not described separately.

Further, the embodiments of the present invention may be freely combined provided that such combinations won't go against the thinking of the present invention. Likewise, they should also be deemed as the content disclosed by the present invention.

What is claimed is:

1. A method for preparing a hypereutectoid steel rail comprising:

rolling a billet after temperature holding treatment to obtain a steel rail, implementing natural cooling till railhead surface temperature is reduced to 750-850° C., carrying out the first cooling stage by adopting a cooling medium to reduce railhead surface temperature to 350-550° C., and then carrying out the second cooling stage by air cooling to reduce railhead surface temperature to 15-40° C., wherein, composition of the billet is: C: 0.86-1.05 wt. %; Si: 0.3-1 wt. %; Mn: 0.5-1.3 wt. %; Cr: 0.15-0.35 wt. %; Cu: 0.3-0.5 wt. %; P: 0.02-0.04 wt. %; S: ≤0.02 wt. %; Ni: ½-⅔ of the content of Cu; at least one of V, Nb and Re; Fe and unavoidable impurities of the rest; under the condition that there is at least one of V, Nb and Re, the content of V is 0% or 0.04-0.12 wt. %, the content of Nb is 0% or 0.02-0.06 wt. %, and the content of Re is 0-0.05 wt. %.

2. The preparation method according to claim 1 wherein in the billet, the content of C is 0.9-1.05 wt. %, the content of Si is 0.4-1 wt. %, the content of Mn is 0.8-1.3 wt. % and the content of P is 0.025-0.04 wt. %.

3. The preparation method according to claim 1 wherein the billet contains one of V, Nb and Re, and contains 0.04-0.12 wt. % of V, or 0.02-0.06 wt. % of Nb, or 0.01-0.05 wt. % of Re.

4. The preparation method according to claim 2 wherein the billet contains one of V, Nb and Re, and contains 0.04-0.12 wt. % of V, or 0.02-0.06 wt. % of Nb, or 0.01-0.05 wt. % of Re.

5. The preparation method according to claim 1 wherein the natural cooling reduces railhead surface temperature to 780-850° C.

6. The preparation method according to claim 4 wherein the natural cooling reduces railhead surface temperature to 780-850° C.

7. The preparation method according to claim 5 wherein the natural cooling reduces railhead surface temperature to 800-840° C.

8. The preparation method according to claim 6 wherein the natural cooling reduces railhead surface temperature to 800-840° C.

9. The preparation method according to claim 1 wherein the first cooling stage reduces railhead surface temperature to 350-500° C.

10. The preparation method according to claim 7 wherein the first cooling stage reduces railhead surface temperature to 350-500° C.

11. The preparation method according to claim 9 wherein the first cooling stage reduces railhead surface temperature to 400-450° C.

12. The preparation method according to claim 1 wherein the cooling speed of the first cooling stage is 1-5° C./s.

13. The preparation method according to claim 9 wherein the cooling speed of the first cooling stage is 1-5° C./s.

14. The preparation method according to claim 1 wherein the first cooling stage comprises applying cooling medium to the top surface and side surfaces of the railhead, and the cooling medium is compressed air and/or water mist mixed gas.

15. A hypereutectoid steel rail prepared by the method according to claim 1.

16. The hypereutectoid steel rail according to claim 15 wherein in the method for preparing the hypereutectoid steel rail, in the billet, the content of C is 0.9-1.05 wt. %, the content of Si is 0.4-1 wt. %, the content of Mn is 0.8-1.3 wt. % and the content of P is 0.025-0.04 wt. %.

17. The hypereutectoid steel rail according to claim 16 wherein in the method for preparing the hypereutectoid steel rail, the billet contains one of V, Nb and Re, and contains 0.04-0.12 wt. % of V, or 0.02-0.06 wt. % of Nb, or 0.01-0.05 wt. % of Re.

* * * * *